US008905515B2

(12) United States Patent
Ito

(10) Patent No.: US 8,905,515 B2
(45) Date of Patent: Dec. 9, 2014

(54) LIQUID EJECTION APPARATUS

(71) Applicant: Brother Kogyo Kabushiki Kaisha, Nagoya-shi, Aichi-ken (JP)

(72) Inventor: Takashi Ito, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/777,731

(22) Filed: Feb. 26, 2013

(65) Prior Publication Data

US 2013/0229459 A1 Sep. 5, 2013

(30) Foreign Application Priority Data

Mar. 5, 2012 (JP) ..... 2012-047727

(51) Int. Cl.
*B41J 2/165* (2006.01)

(52) U.S. Cl.
CPC ..... *B41J 2/16505* (2013.01); *B41J 2/16585* (2013.01); *B41J 2/16526* (2013.01); *B41J 2002/16573* (2013.01)
USPC ..... 347/32

(58) Field of Classification Search
USPC ..... 347/20–36
See application file for complete search history.

(56) References Cited

U.S. PATENT DOCUMENTS

| | | | |
|---|---|---|---|
| 6,089,697 | A | 7/2000 | Tajika et al. |
| 6,257,696 | B1 | 7/2001 | Nakamura |
| 2001/0003459 | A1 | 6/2001 | Saijo |
| 2006/0221121 | A1 | 10/2006 | Ide et al. |

FOREIGN PATENT DOCUMENTS

| | | | |
|---|---|---|---|
| JP | H08-281975 | A | 10/1996 |
| JP | H10-278304 | A | 10/1998 |
| JP | H10-291327 | A | 11/1998 |
| JP | 2006-289623 | A | 10/2006 |

*Primary Examiner* — Matthew Luu
*Assistant Examiner* — Renee I Wilson
(74) *Attorney, Agent, or Firm* — Merchant & Gould PC

(57) ABSTRACT

A liquid ejection apparatus includes: a first head having a plurality of nozzles from which a first liquid including pigments is ejected; a second head having a plurality of nozzles from which a second liquid including no pigments is ejected; a cap device selectively positioned at a capping position and at an uncapping position; a purging executing portion configured to perform a first purging and a second purging, and to perform the first purging greater in number of times than the second purging in a certain purging period and to perform the first purging as the last purging operation in the certain purging period; and a cap controller configured to control a position of the cap device.

8 Claims, 7 Drawing Sheets

FIG.8A $(Bk)^n \rightarrow (Pr \rightarrow Bk)^m$

FIG.8B $(Pr \rightarrow Bk)^m \rightarrow (Bk)^m \rightarrow (Pr \rightarrow Bk)^m$ FIG.8C $(Pr \rightarrow Bk)^m \rightarrow (Bk)^m$ m: natural number
n: natural number not less than 2

Bk: purging for inkjet head 10b (first purging)
Pr: purging for pretreatment-liquid ejection head 10a (second purging)

LIQUID EJECTION APPARATUS

CROSS REFERENCE TO RELATED APPLICATION

The present application claims priority from Japanese Patent Application No. 2012-047727, which was filed on Mar. 5, 2012, the disclosure of which is herein incorporated by reference to its entirety.

BACKGROUND OF THE INVENTION

1. Field of the Invention

The present invention relates to a liquid ejection apparatus which has a first head to eject a first liquid including pigments and a second head to eject a second liquid including no pigments.

2. Description of Related Art

There is known an inkjet printer having a head (a first head) which ejects ink (a first liquid including pigments) and another head (a second head) which ejects a print-performance enhancing liquid (a second liquid including no pigments).

There is also known such a technique that a purging is performed in order for a plurality of heads which eject liquids different from each other. The purging is an operation to discharge a liquid from nozzles or ejection openings of a head and leads to recovering of the ejection performance of the head. While the purging is not performed, the nozzles are covered by a preservation cap in order to prevent drying.

SUMMARY OF THE INVENTION

In a case where the purging is performed for the first head and the second head, it can be considered that, in a certain purging period which consists of a combination of at least one first purging that is a purging for the first head and at least one second purging that is a purging for the second head, a sequence (in which the first purging and the second purging are alternately performed and the second purging is performed after the first purging) is performed m number of times (m: natural number). The present inventor noticed that the following problems occur in this case.

A first problem is due to a discharge amount of the second liquid. Since the second liquid does not include pigments, the recovery degree by one purging is high. Therefore, a purging for the second head may be performed a smaller number of times than a purging for the first head, but in the above-mentioned case, the first purging and the second purging are performed the same number of times. In other words, the second liquid is uselessly discharged.

A second problem is due to drying of the nozzles of the first head. From the nozzles of the first head, the first liquid including pigments is ejected. Since the first liquid is directly related to a print quality, it is especially necessary that the nozzles of the first head be prevented from drying. In the above-mentioned case, at the end of the certain purging period, the second purging is performed. Since the first head is not covered by a cap in the last second purging, drying of the nozzles of the first head increases.

It is therefore an object of the present invention to provide a liquid ejection apparatus to reduce the discharge amount of the second liquid and to restrain drying of the nozzles of the first head.

In order to achieve the above-mentioned object, according to the present invention, there is provided a liquid ejection apparatus comprising: a first head having a plurality of nozzles from which a first liquid including pigments is ejected; a second head having a plurality of nozzles from which a second liquid including no pigments is ejected; a cap device configured to be selectively positioned at a capping position where the cap device covers the plurality of nozzles of the first head and the plurality of nozzles of the second head, and at an uncapping position where the cap device does not cover the plurality of nozzles of the first head and the plurality of nozzles of the second head; a purging executing portion configured to perform a first purging in which the first liquid is discharged from the plurality of nozzles of the first head and a second purging in which the second liquid is discharged from the plurality of nozzles of the second head, and to perform the first purging greater in number of times than the second purging in a certain purging period constituted by a combination of at least one first purging and at least one second purging and to perform the first purging as the last purging operation in the certain purging period; and a cap controller configured to control a position of the cap device so as to be positioned at the uncapping position in the certain purging period and at the capping position at least in periods before and after the certain purging period.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which:

FIGS. 8A through 8C are explanatory views showing respective purging patterns in a certain purging period and correspond to the first, a second and a third embodiments, respectively.

DETAILED DESCRIPTION OF THE PREFERRED EMBODIMENTS

There will be described preferred embodiments of the invention with reference to the drawings.

There will be described an overall structure of an inkjet printer 1 as a first embodiment to which the present invention is applied with reference to FIG. 1.

The inkjet printer 1 includes a casing 1*a* having a rectangular parallelepiped shape. In an upper portion of a top panel of the casing 1*a*, there is disposed a sheet-discharge portion 31. In an inner space of the casing 1*a*, there is formed a conveying path through which a recording sheet P is conveyed from a sheet-supply unit 1*c* to the sheet-discharge portion 31 along a thick arrow A in FIG. 1.

Figure 6:
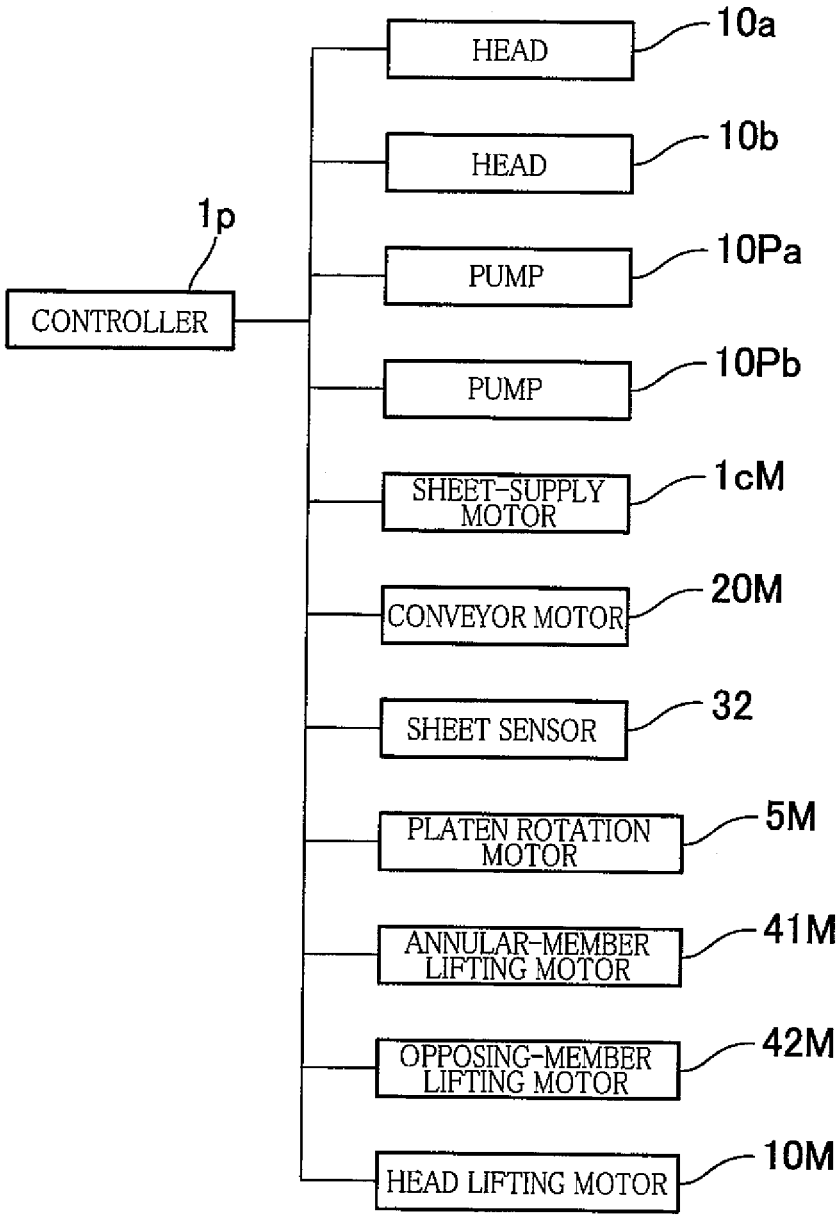
FIG. 6 is a block diagram showing an electrical structure of the printer.

In a lower space of the casing la and below the sheet-supply unit 1*c*, there are disposed cartridges 2*a*, 2*b*. The cartridge 2*a* stores a pretreatment liquid as an example of a second liquid and the cartridge 2*b* stores a black ink as an example of a first liquid. While the pretreatment liquid does not contain pigments, the black ink contains pigments. The pretreatment liquid is a liquid having functions to prevent ink being blurred and bled and to enhance a chromogenic effect and a fast-drying effect by coagulating pigment particles in ink, and so forth. The pretreatment liquid may contain multivalent metal salt such as cationic polymer, magnesium salt and so on. The cartridges 2*a*, 2*b* are respectively communicated to a pretreatment-liquid ejection head 10*a* as an example of a second head and an inkjet head 10*b* as an example of a first head via tubes or the like. A controller 1*p* controls pumps 10Pa, 10Pb (shown in FIG. 6) such that liquids in the cartridges 2*a*, 2*b* are timely supplied to corresponding heads 10*a*, 10*b*.

In the inner space of the casing la, there are accommodated the heads 10*a*, 10*b*, the controller 1*p*, a conveyor unit 20, a support mechanism 5 and opposing members 42 that are disposed below the heads 10*a*, 10*b*, the sheet-supply unit 1*c*, and so forth.

Figure 1:
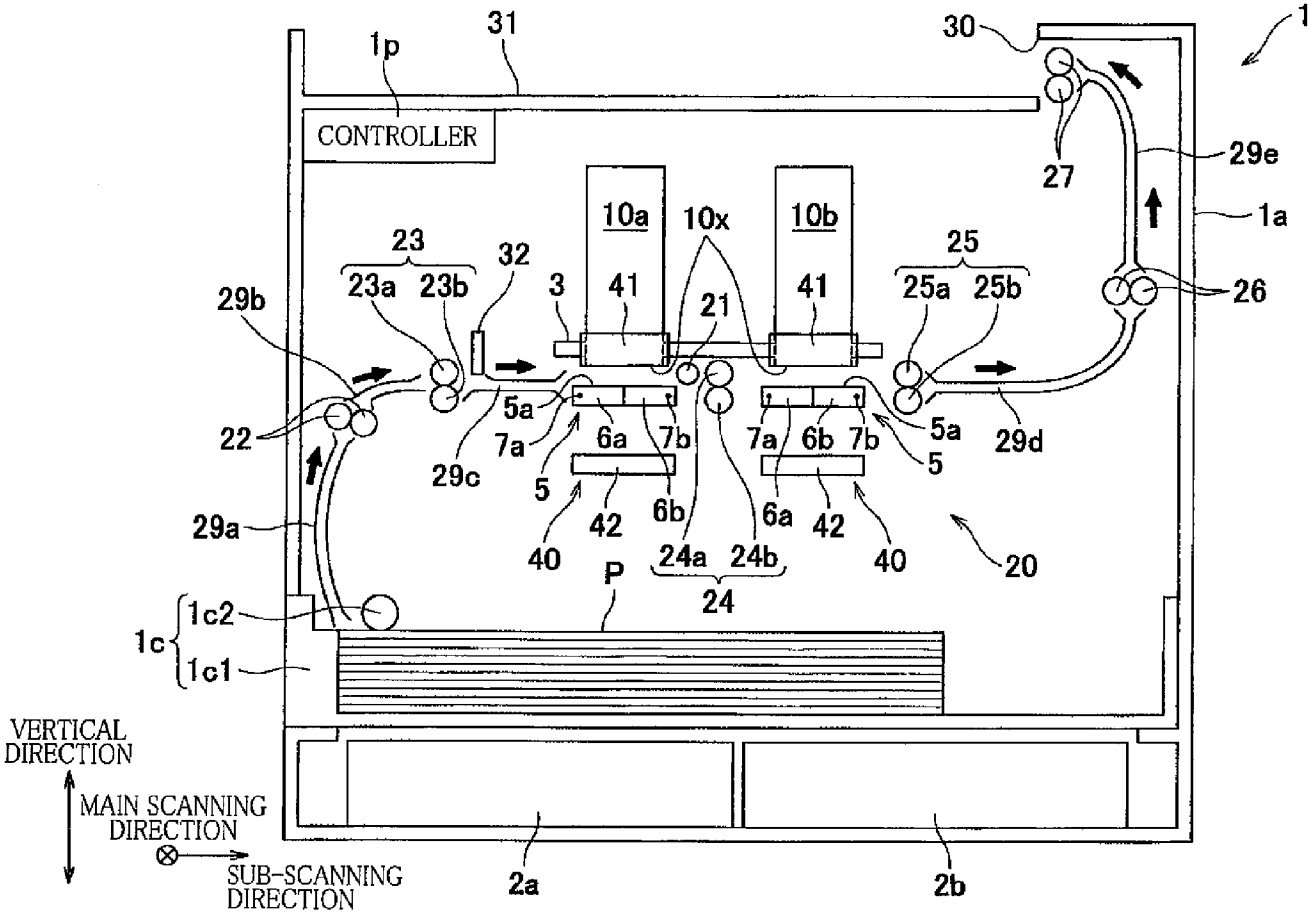
FIG. 1 is a cross-sectional view schematically showing an internal structure of an inkjet printer as a first embodiment to which the present invention is applied.

The heads 10*a*, 11*a*, having the same structure, are line-type heads having a generally rectangular parallelepiped shape extending in a main scanning direction (a direction perpendicular to a sheet plane of FIG. 1). When recording (image forming), the pretreatment liquid and the black ink (hereinafter these may be generally referred to as liquid) are respectively ejected from lower surfaces (ejection surfaces 10*x*) of the corresponding heads 10*a*, 10*b*. The heads 10*a*, 10*b* are arranged side by side in a sub-scanning direction (a direction perpendicular to the main scanning direction and a vertical direction) at a predetermined pitch and supported by the casing 1*a* via a holder 3. The holder 3 also supports annular members 41 that are disposed corresponding to the respective heads 10*a*, 10*b*. The annular member 41 is a member formed annularly so as to enclose an outer circumference of the ejection surface 10*x* in its plan view.

The opposing member 42 is a rectangular plate that is slightly larger than the annular member 41 and is composed of a material which does not absorb water (moisture) or is hard to absorb water such as glass, metal (e.g., SUS) or the like. The annular member 41 and the opposing member 42 form a cap 40 as an example of a cap device. The cap 40 will be described in detail later.

The support mechanism 5 consists of two platens 6*a*, 6*b*. The platens 6*a*, 6*b* are pivotable (rotatable) about respective shafts 7*a*, 7*b*. Under control of the controller 1*p*, the platens 6*a*, 6*b* are pivotable between a support-surface-forming position (shown in FIG. 1) and an open position (shown in FIG. 5B) by driving of a platen rotation motor 5M (shown in FIG. 6). At the support-surface-forming position, respective ends of the platens 6*a*, 6*b* are opposed to each other such that the platens 6*a*, 6*b* form a support surface 5*a* which supports the recording sheet P at a position opposed to the ejection surface 10*x*. The support surface 5*a* is a flat surface as a whole. The platens 6*a*, 6*b* are positioned at the support-surface-forming position when recording and the platens 6*a*, 6*b* are positioned at the open position when maintenance is performed.

In the present embodiment, the maintenance includes a capping, a purging, a wiping, and so on. The maintenance will be described in detail later.

The conveyor unit 20 includes pairs of rollers 22, 23, 24, 25, 26, 27, guides 29*a*, 29*b*, 29*c*, 29*d*, 29*e* and an intermediate roller 21.

The pairs of rollers 22 through 27 are arranged in this order from an upstream side in a conveying direction so as to form the conveying path from the sheet-supply unit 1*c* to the sheet-discharge portion 31. Lower rollers 23*b*, 24*b*, and 25*b* of the pairs of rollers 23 through 25 are connected to a conveyor motor 20M (shown in FIG. 6). One of the pair of rollers 26 and one of the pair of rollers 27 are connected to the conveyor motor 20M. The rollers connected to the conveyor motor 20M are driving rollers rotated by driving of the conveyor motor 20M under control of the controller 1*p*. Upper rollers 23*a*, 24*a* and 25*a* and the other rollers of the pairs of rollers 26, 27 are driven rollers.

The guides 29*a* through 29*e* are arranged in this order from the upstream side in the conveying direction between the sheet-supply unit 1*c* and the pair of rollers 22, the pair of rollers and so on so as to form the conveying path. Each of the guides 29*a* through 29*e* is composed of a pair of plates that are spaced from each other in a planar direction.

The intermediate roller 21 is located between the head 10*a* and the pair of rollers 24 and on an upper side of the conveying path.

The sheet-supply unit 1*c* includes a sheet-supply tray 1*c*1 and a sheet-supply roller 1*c*2. The sheet-supply tray 1*c*1 is detachably attached to the casing 1*a* in the sub-scanning direction. The sheet-supply tray 1*c*1 is a box-like structure opening upward and can accommodate the recording sheets P with a plurality of sizes. The sheet-supply roller 1*c*2 is rotated by driving of a sheet-supply motor 1*c*M (shown in FIG. 6) under the control of the controller 1*p* so as to supply an uppermost one of the recording sheets P in the sheet-supply tray 1*c*1.

The controller 1*p* includes, in addition to a CPU (Central Processing Unit) as an arithmetic processing unit, a ROM (Read Only Memory), a RAM (Random Access Memory: including a non-volatile RAM), an ASIC (Application Specific Integrated Circuit), an I/F (Interface), an I/O (Input/Output Port), and so forth. The ROM stores programs that are executed by the CPU, various fixed data, and so on. The RAM temporality stores data (image data and so on) necessary when executing of the programs. In the ASIC, rewriting, sorting of the image data, and so on, e.g., signal processing and image processing, are performed. The I/F transmits and receives data to and from an external device. The I/O performs input/output of detection signals of various sensors.

Based on recording command supplied from the external device such as a PC connected to the printer 1, the controller 1*p* controls preparation operations related to recording, supplying/conveying/discharging operations of the recording sheet P, liquid ejection which is synchronized with the conveying of the recording sheet P, and so forth such that an image is recorded on the recording sheet P. The recording sheet P supplied from the sheet-supply unit 1*c*, nipped by the pair of rollers 22 through 27, passes through a space between the guides 29*a* through 29*e* and is conveyed in the conveying direction. When the recording sheet P passes right below the heads 10*a*, 10*b*, in order, while supported on the support surfaces 5*a*, the heads 10*a*, 10*b* are driven by the control of the controller 1*p* to eject the liquid to a surface of the recording sheet P from nozzles 14*a* (shown in FIG. 3) on the respective ejection surfaces 10*x*, so that an image is recorded on the recording sheet P. The liquid ejection from the nozzles 14*a* is performed based on detection signals from a sheet sensor 32 which detects a (leading) end of the recording sheet P. After image recording, the recording sheet P is conveyed upward and discharged from an opening 30 that is formed on an upper portion of the casing 1*a* to the sheet-discharge portion 31.

Figure 2:
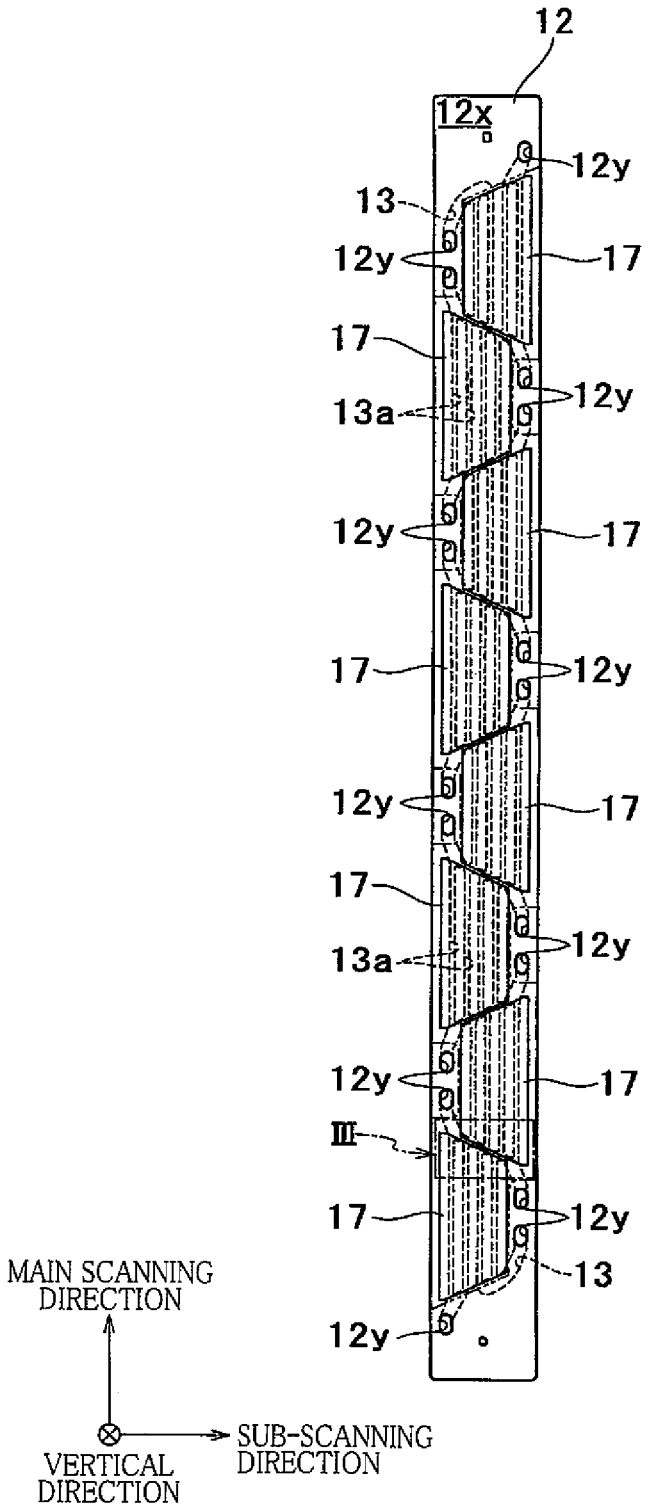
FIG. 2 is a plan view showing a channel unit included in respective heads of the printer shown in FIG. 1.

Hereinafter, structures of the heads 10*a*, 10*b* will be described in detail with reference to FIGS. 2 through 4.

Each of the heads 10*a*, 10*b* includes a reservoir unit and a channel unit 12 which are stacked on each other in a vertical direction, eight actuator units 17 which are fixed to an upper surface 12*x* of the channel unit 12, a FPC (Flexible Printed Circuit board) 19 which are connected (bonded) to the respective actuator units 17, and so on. In the reservoir unit, there is formed a channel including a reservoir. The reservoir temporarily stores liquid supplied from corresponding accommodating portions of the cartridges 2*a*, 2*b*. In the channel unit 12, there are formed channels extending from a plurality of openings 12*y* formed on the upper surface 12*x* to each of the plurality of nozzles 14*a* formed on a lower surface (the ejection surface 10*x*). The actuator unit 17 includes a piezoelectric actuator for each nozzle 14*a*.

A lower surface of the reservoir unit has a concave portion and a convex portion. The convex portion of the reservoir unit is adhered to an area of the upper surface 12*x* of the channel unit 12 so as to avoid the actuator units 17. More specifically, an area including the openings 12*y* enclosed by a two-dot chain line shown in FIG. 2 is the area to which the convex portion is adhered. On a (lower) surface of the convex portion, there are formed a plurality of openings that are connected to the reservoir and are opposed to the corresponding openings 12*y*. Accordingly, via the above-mentioned openings, liquid is supplied from the reservoir to the channel unit 12. The concave portion of the reservoir unit is opposed to the upper surface 12*x* of the channel unit 12, upper surfaces of the actuator units 17 and an upper surface of the FPC 19 with a slight clearance being made therebetween.

The channel unit 12 has a laminar structure which includes nine rectangular metallic plates 12*a*, 12*b*, 12*c*, 12*d*, 12*e*, 12*f*, 12*g*, 12*h*, 12*i* (shown in FIG. 4) having the generally same size that are stacked on, and adhered to, each other. A channel formed in the channel unit 12 includes a manifold channel 13 having the opening 12*y* at one of opposite ends thereof, a sub-manifold channel 13*a* that is branched from the manifold channel 13, and an individual channel 14 extending from an outlet of the sub-manifold channel 13*a* to each nozzle 14*a* via a pressure chamber 16. The individual channel 14 is formed for each nozzle 14*a* and includes an aperture 15 functioning as a throttle valve for adjusting a channel resistance. In adhesion areas of the upper surface 12*x* of the channel unit 12 to which the actuator units 17 are respectively adhered, generally rhombic-shaped openings through which the pressure chambers 16 are exposed are arranged like a matrix. In areas of the lower surface (the ejection surface 10*a*) corresponding to the adhesion areas, the nozzles 14*a* are arranged like a matrix in the same manner as the arrangement of the pressure chambers 16.

Figure 3:
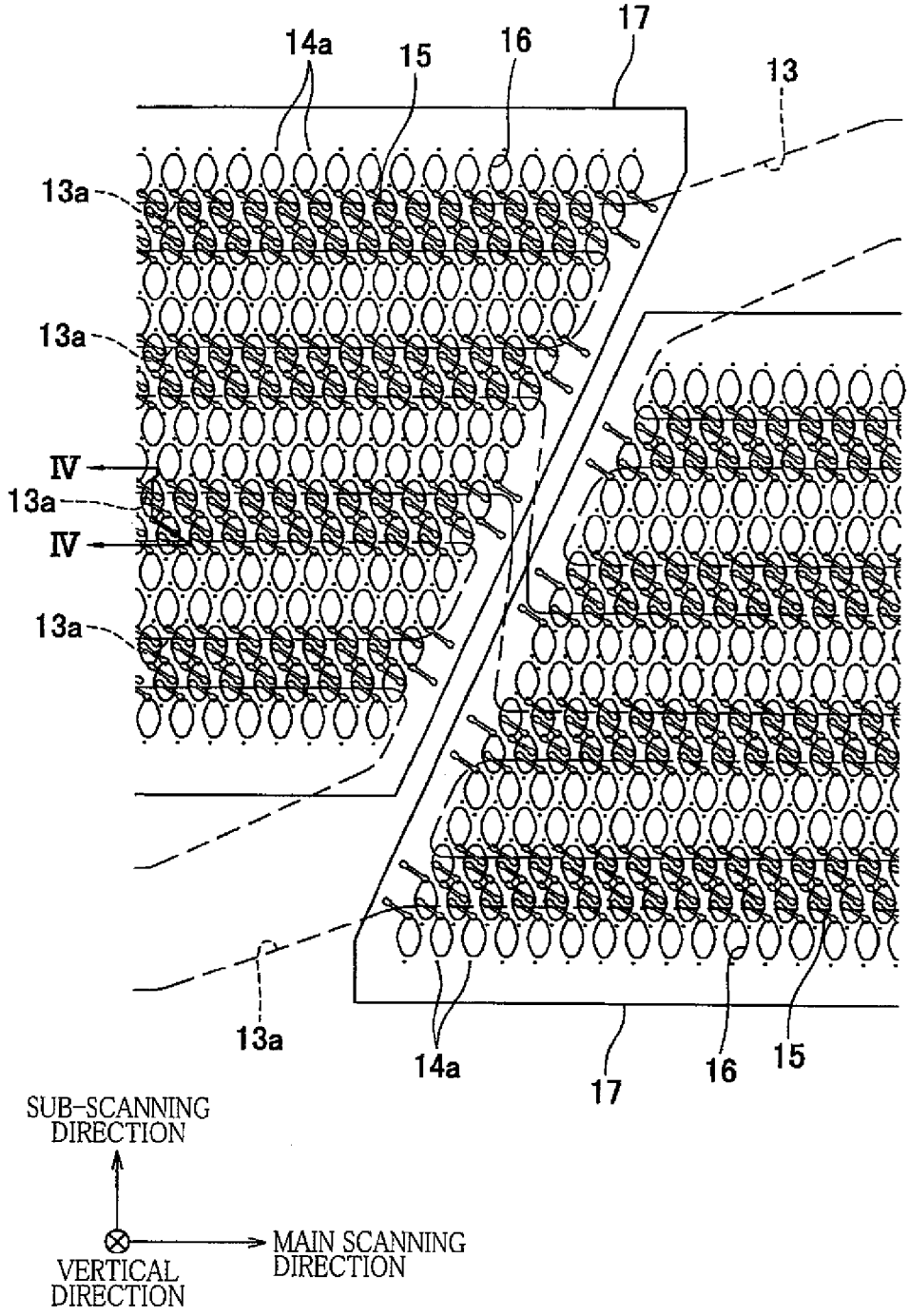
FIG. 3 is an enlarged view showing an area III enclosed by a one-dot chain line in FIG. 2.
Figure 4:
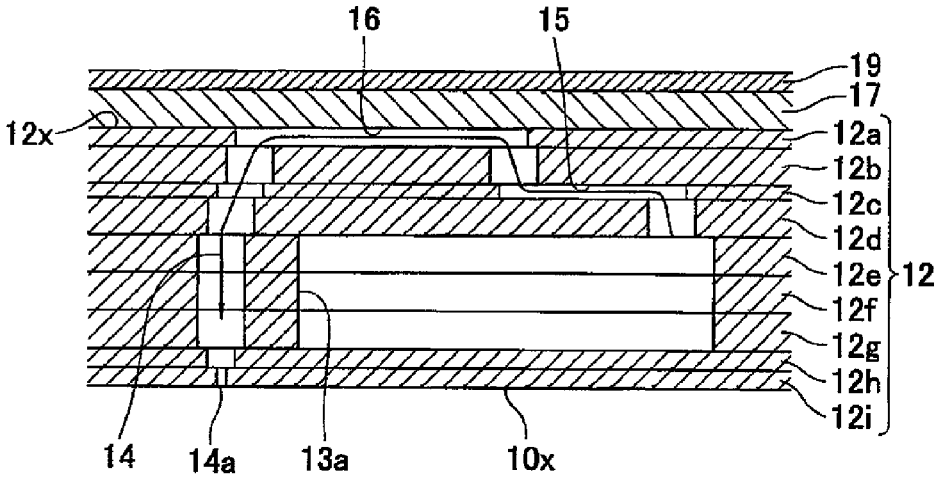
FIG. 4 is a cross-sectional view taken along a line IV-IV in FIG. 3.

In FIG. 3, the plurality of pressure chambers 16 and a plurality of apertures 15 are indicated by solid lines, though the pressure chambers 16 and the apertures 15 should be shown by broken lines because these are located below the actuator units 17.

The actuator units 17, each of which has a trapezoidal shape in its plan view, are arranged in two rows and in a zigzag or a staggered manner. Each actuator unit 17 covers corresponding ones of a multiplicity of openings of the pressure chambers 16. The actuator unit 17 consists of a piezoelectric layer, an oscillating plate, a common electrode and individual electrodes, which are not shown. The piezoelectric layer, the oscillating plate and the common electrode have a trapezoidal shape of a size that defines an external configuration of the actuator unit 17. The individual electrodes are disposed for each pressure chamber 16 and are opposed to the corresponding pressure chambers 16 on an upper surface of the piezoelectric layer. The oscillating plate is disposed between the common electrode and the pressure chambers 16. A portion of the actuator unit 17 corresponding to each individual electrode functions as a certain piezoelectric actuator. Each actuator is individually deformable by applying of voltage via the FPC 19 so as to change a volume of the corresponding pressure chamber 16 and apply energy to liquid in the pressure chamber 16. Accordingly, liquid is ejected from the nozzles 14*a*.

The FPC 19 has wires corresponding to the respective electrodes of the actuator units 17, and a driver IC is mounted on a middle portion of each wire of the FPC 19. One end portion of (each wire of) the FPC 19 is connected to the corresponding actuator units 17, and the other is connected to circuit boards of the heads 10*a*, 10*b*. The circuit board adjusts signals inputted from the controller 1*p* and outputs the adjusted signals to the driver IC via the wires of the FPC 19. The driver IC converts the signals inputted from the circuit board into drive signals and transmits the drive signals to each electrode of the actuator units 17 via the wires of the FPC 19.

Figure 5A:
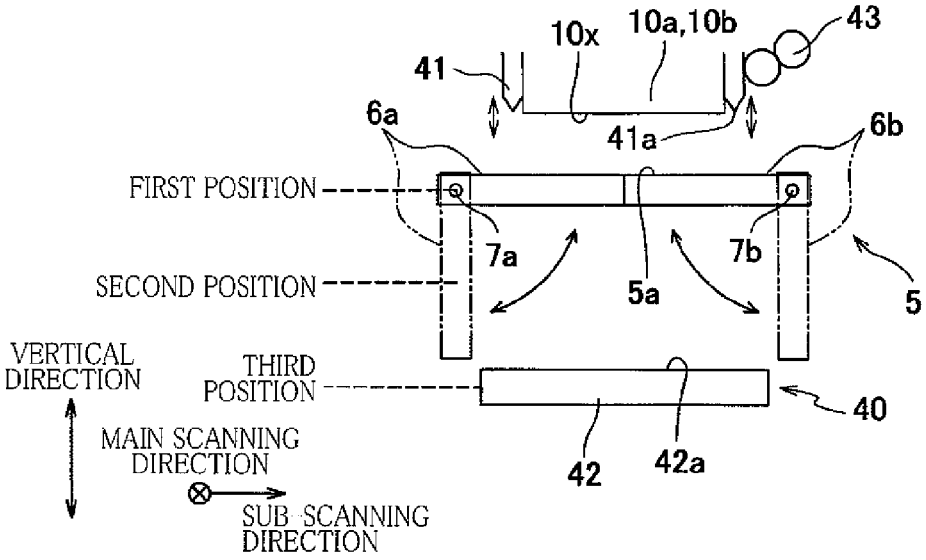
FIG. 5A and FIG. 5B are illustrative views for explaining operations of a cap and a support mechanism.
Figure 5B:
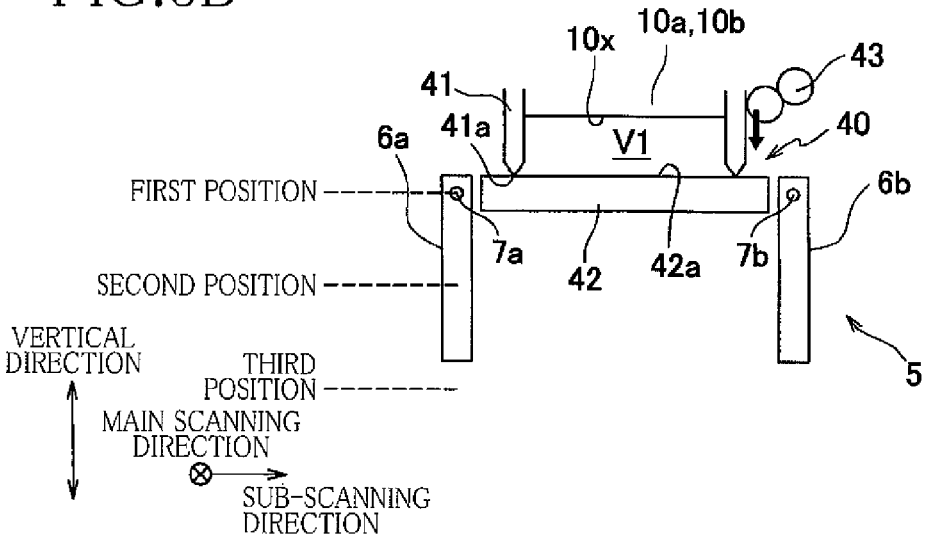

Hereinafter, a structure of the cap 40, the capping operation, the purging operation and so on will be described with reference to FIGS. 5A and 5B.

The annular member 41 is connected to a plurality of gears 43, and the plurality of gears 43 are rotated by driving of an annular-member lifting motor 41M (shown in FIG. 6) under the control of the controller 1*p* such that the annular member 41 moves up and down. One end (a lower end) of the annular member 41 is movable up and down and the other end (a base end) is fixed to a side surface of each of the heads 10*a*, 10*b* along its circumference.

The opposing member 42 is connected to an opposing-member lifting motor 42M (shown in FIG. 6) and moves up and down by driving of the opposing-member lifting motor 42M under the control of the controller 1*p*. The opposing member 42 can be positioned at either one of a first, a second and a third positions. The first position is located at the highest (uppermost) position, the third position is at the lowest position, and the second position is located at a position lower than the first position and higher than the third position. The opposing member 42 is positioned at the first position during the capping, at the second position during the purging, at the third position during the recording or on standby. When the opposing member 42 is positioned at the first position, a distance between an opposing surface 42*a* (a surface of the opposing member 42 and a surface opposed to the ejection surface 10*x* when the platens 6*a*, 6*b* are at the open position) and the ejection surface 10*x* is equal to a distance between the support surface 5*a* and the ejection surface 10*x* when the recording.

The cap 40 can be positioned at a capping position (FIG. 5B) where an ejection space V1 opposed to the ejection surface 10*x* of the corresponding one of the heads 10*a*, 10*b* is defined such that the cap 40 covers the nozzles 14*a*. The cap 40 can be positioned at an uncapping position (FIG. 1 and FIG. 5A) where the ejection space V1 of the corresponding one of the heads 10*a*, 10*b* is opened such that the cap 40 does not cover the nozzles 14*a*. When the cap 40 is positioned at the capping position, a clearance between the ejection surface 10*x* and the opposing surface 42*a* is defined by the annular member 41 as the ejection space V1.

The capping means that the cap 40 is kept at the capping position. In the present embodiment, in a case where the cap 40 is positioned at the capping position, as shown in FIG. 5B, the controller 1*p* makes the annular member 41 move down in a state in which the support mechanism 5 is positioned at the open position and the opposing member 42 is positioned at the first position. Accordingly, the lower end 41*a* of the annular member 41 is held in contact with the opposing surface 42*a* so as to define the ejection space V1. The capping operation is performed, for example, when the recording command has not been received for a period of time equal to or longer than a predetermined period of time, and so forth. Because the ejection space V1 is defined by the capping operation, the ejection space V1 is prevented from drying and viscosity (thickening) of liquid in the nozzles 14*a* is restrained.

On the capping operation, the two annular members 41 corresponding to the respective heads 10*a*, 10*b* are simultaneously driven, and the two opposing members 42 corresponding to the respective heads 10*a*, 10*b* are also driven simultaneously. In this case, simplified structure and control can be realized, compared to a case where composing elements of the cap 40 are driven independently for each heads 10*a*, 10*b*.

The purging operation is an operation in which liquid is sent to the heads 10*a*, 10*b* by driving of pumps 10Pa, 10Pb (shown in FIG. 6) such that the liquid is forcibly discharged from the nozzles 14*a*. The liquid discharged by the purging operation is received on the opposing surfaces 42 of the heads 10*a*, 10*b*. Due to the purging operation, thicken liquid and liquid containing foreign matters (dusts, bubbles, and so on) in the nozzles 14*a* are discharged, so that the ejection performance can be recovered.

Though the pumps 10Pa, 10Pb are respectively provided for the heads 10*a*, 10*b*, a power source for the purging operation is common to the heads 10*a*, 10*b*. Switching of a purging object (the head 10*a* or the head 10*b*) is made by a switching mechanism to which planetary gears are applied.

After the purging operation, the wiping operation is performed. The wiping operation is an operation in which a plate-like wiper made of an elastic material such as rubber and so forth is moved relative to an object (ejection surface 10*x* or the opposing surface 42*a*), in a state in which the wiper is in contact with the object such that foreign matters on the object are removed. The wiping operation includes a wiping on the ejection surface 10*x* and a wiping on the opposing surface 42*a*. Depending on a structure of the wiper, the wiping on the opposing surface 42*a* may be performed after the wiping on the ejection surface 10*x*, or the wiping on the ejection surface 10*x* and the wiping on the opposing surface 42*a* may be performed simultaneously. There are disposed respective wipers corresponding to the heads 10*a*, 10*b*. The respective wipers are moved in a lengthwise direction of the heads 10*a*, 10*b* (in the main scanning direction) in the wiping operation and moved back to a waiting position after the wiping operation. The waiting position of the wiper is located in the vicinity of one end of the heads 10*a*, 10*b* in the lengthwise direction.

Though the wipers are respectively provided for the heads 10*a*, 10*b*, a power source for the wiping operation is common to the heads 10*a*, 10*b*. Switching of a wiping object (the ejection surface 10*x* or the opposing surface 42*a*) is made by another switching mechanism to which planetary gears are applied.

The purging and the wiping is performed as a set for each heads 10*a*, 10*b*.

Figure 7:
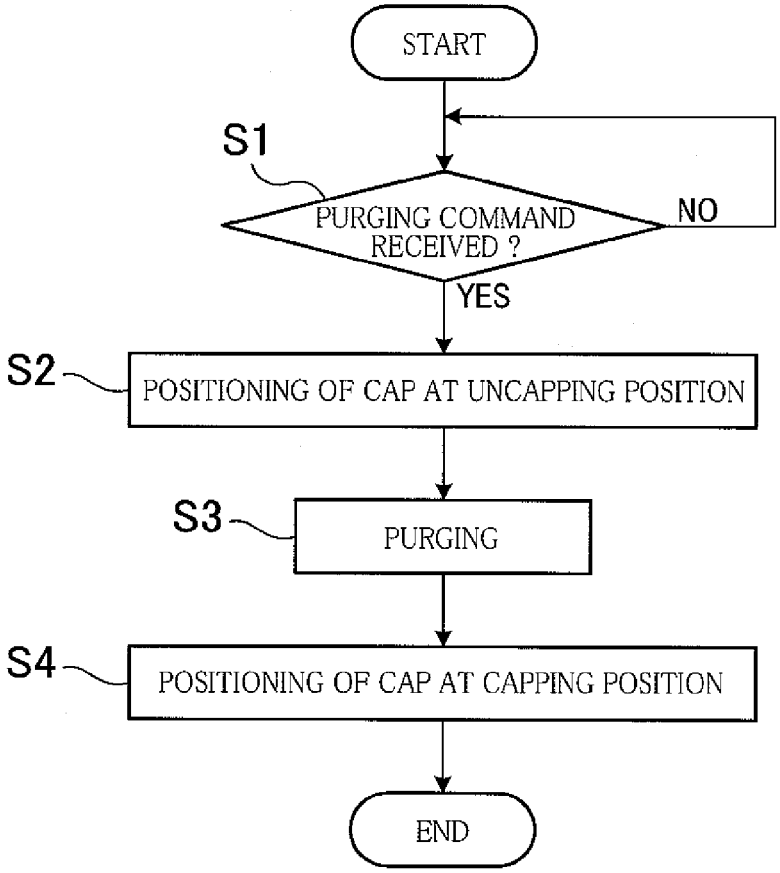
FIG. 7 is a flow chart showing a purging control implemented by the controller.

Hereinafter, a purging control executed by the controller 1*p* will be described with reference to FIGS. 7 and 8A.

The controller 1*p* first determines whether a purging command is received (step 1: hereinafter "step" is omitted and referred to as "S", S1). In a case where the capping operation continues for a period equal to or longer than a predetermined period of time, the controller 1*p* receives the purging command.

When the controller 1*p* has received the purging command (S1: YES), the controller 1*p* makes the cap 40 to be positioned at the capping position (S2). At the time, as shown in FIG. 5B, the controller 1*p* keeps the support mechanism 5 at the open position and the opposing member 42 at the first position, and the controller 1*p* controls the annular-member lifting motor 41M (shown in FIG. 6) to drive to rotate the gears such that the annular member 41 moves up. Thus, the lower end 41*a* of the annular member 41 is distanced from the opposing surface 42*a* and the ejection space V1 is opened. The controller 1*p* then makes the opposing member 42 move to the second position by driving of the opposing-member lifting motor 42M.

The controller 1*p* performs the purging operation after execution of S2 (S3). At the time, the controller 1*p* keeps the support mechanism 5 at the open position, the opposing member 42 at the second position, and the cap 40 at the uncapping position, and the controller 1*p* controls driving of the pumps 10Pa, 10Pb and so forth so as to realize a purging pattern shown in FIG. 8A. In the purging pattern of FIG. 8A, first a Bk purging (a purging for the inkjet head 10*b*; an example of a first purging) is performed n times consecutively (n: natural number equal to or greater than 2), and then, a sequence in which one Bk purging is performed following one Pr purging (a purging for the pretreatment-liquid ejection head 10*a*; an example of a second purging) is performed m times (m: natural number). After each of the purgings (each of the Bk purgings and each of the Pr purgings), the wiping is performed as described before. In the purging pattern of FIG. 8A, in a certain purging period constituted by a combination of at least one Bk purging and at least one Pr purging, the number of times of the at least one Bk purging is greater than that of the at least one Pr purging and the Bk purging is performed as the last purging. The driving number of times of the pumps 10Pa, 10Pb in each of the Bk purging and the Pr purging can be properly determined.

Further, in a case where it is defined that a first purging period is a period necessary for the first purging (the Bk purging) to be performed once and a second purging period is a period necessary for the second purging (the Pr purging) to be performed once, the certain purging period necessary for the purging operation consisting of the combination of the at least one Bk purging and the at least one Pr purging is a period substantially consisting of at least one first purging period and at least one second purging period. In other words, though the certain purging period of the purging pattern of FIG. 8A consists of consecutive n times of the first purging period and subsequently consecutive m times of a period necessary for the sequence in which the first purging period follows the second purging period. As long as the certain purging period substantially consists of at least one first purging period and at least one second purging period, there may exist non-purging period, in which no purging is performed, between the two consecutive purging periods in the certain purging period or between two consecutive sequences. In the case where the first purging period and the second purging period are defined above, in the purging pattern of FIG. 8, the certain purging period includes the first purging period greater in number than the second purging period, and the first purging is a purging performed in the last purging period among a plurality of purging periods included in the certain purging period. Furthermore, in the purging pattern of FIG. 8A, two consecutive second purgings are not performed in the certain purging period, i.e., two second purging periods are not consecutive. More specifically, in the purging pattern of FIG. 8A, in the certain purging period, the first purging is performed following the second purging. Moreover, in the purging pattern of FIG. 8A, in the certain purging period, the first purging is performed consecutively at least twice, i.e., the first purging period continues at least twice. Further, in the purging pattern of FIG. 8A, at the end of the certain purging period, the sequence in which the first purging is performed following the second purging is performed at least once. In other words, in the purging pattern of FIG. 8A, as the last two purgings in the certain purging period, the second purging and the first purging following the second purging are performed. Described in another way, in the purging pattern of FIG. 8A, the second purging and the first purging are respectively performed in the last two purging periods among the plurality of purging periods included in the certain purging period, and the first purging is performed following the second purging in the last purging period.

After executing of S3, the controller 1*p* controls the cap 40 to be positioned at the capping position (S4). The controller 1*p* first controls the opposing member 42 to move from the second position to the first position by driving of the opposing-member lifting motor 42M. The controller 1*p* then makes the support mechanism 5 keep at the open position and the opposing member 42 at the first position and the annular-member lifting motor 41M (shown in FIG. 6) drive the gears 43 to rotate such that the annular member 41 moves down. Accordingly, the lower end 41*a* of the annular member 41 comes into contact with the opposing surface 42*a* such that the ejection space V1 is defined between the opposing surface 42*a* and the ejection surface 10*x*.

The controller 1*p* ends the routine after executing of S4.

As mentioned above, in the present embodiment, in the certain purging period constituted by the combination of the at least one Bk purging and the at least one Pr purging, the Bk purgings are greater in number of times than the Pr purging. Therefore, a discharging amount of the pretreatment liquid can be reduced. Further, because the Bk purging is performed as the last purging in the certain purging period, a time period when the head 10*b* waits in a state of being uncapped by the cap 40 at the end of the certain purging period can be decreased. Thus, the nozzles 14*a* of the head 10*b* is restrained from drying.

In a case where the Pr purging is consecutively performed in the certain purging period, drying of the nozzles 14*a* of the head 10*b* is getting worse in the consecutive Pr purgings. On the other hand, in the present embodiment, since the two Pr purgings are not consecutively performed in the certain purging period, the drying of the nozzles 14*a* of the head 10*b* can be restrained.

Because the two Bk purgings are consecutively performed in the certain purging period, decreasing of the discharging amount of the pretreatment liquid and the recovery of the ejection performance of the head 10*b* can be effectively compatible with each other.

In a case where the two Bk purgings are consecutively performed at the end of the certain purging period, drying of the nozzles 14*a* of the head 10*a* is getting worse in the consecutive Bk purgings. On the other hand, in the present embodiment, since the sequence in which the Bk purging is performed following the Pr purging is performed once or a plurality of numbers of times at the end of the certain purging period, the drying of the nozzles 14*a* of the head 10*a* in addition to the drying of the nozzles 14*a* of the head 10*b* can be prevented.

Hereinafter, inkjet printers as a second and a third embodiments to which the present invention is applied will be described.

The printers in the second and the third embodiments have the same structure as the printer 1 in the first embodiment, except that the pumps 10Pa, 10Pb are driven to execute respective purging patterns shown in FIGS. 8B, 8C instead of the purging pattern of FIG. 8A.

In the purging pattern of FIG. 8B in the second embodiment, first, the sequence in which the Bk purging is performed following the Pr purging is performed m times, and then the Bk purging is performed consecutively m times, and thereafter the sequence in which the Bk purging is performed following the Pr purging is performed m times. The purging pattern of FIG. 8B is common to the purging pattern of FIG. 8A in that (A) in the certain purging period, the Bk purgings are performed in greater number of times than the Pr purgings and (B) the Bk purging is performed as the last purging in the certain purging period, (C) the two Pr purgings are not consecutively performed in the certain purging period, (D) the Bk purgings are consecutively performed in the certain purging period, and (E) the sequence in which the Bk purging is performed following the Pr purging is performed once or plural times at the end of the certain purging period.

In the purging pattern of FIG. 8C in the third embodiment, first, the sequence in which the Bk purging is performed following the Pr purging is performed m times, and then the Bk purging is performed consecutively m times. The purging pattern of FIG. 8C is common to the purging pattern of FIG. 8A in that (A) in the certain purging period, the Bk purgings are performed in greater number of times than the Pr purging and (B) the Bk purging is performed as the last purging in the certain purging period, (C) the two Pr purgings are not consecutively performed in the certain purging period, and (D) the two Bk purgings are consecutively performed in the certain purging period.

The second and the third embodiments, having the same structure as the first embodiment, enjoy the similar effects as the first embodiment has.

The present invention is not limited to the illustrated embodiments. It is to be understood that the present invention may be embodied with various changes and modifications that may occur to a person skilled in the art, without departing from the spirit and scope of the invention defined in the appended claims.

The first head and the second head may be of any numbers that are not less than 1. The first and the second heads may be serial-type heads, instead of the line-type heads. The first liquid may be a pigment ink of color, and may be any other liquid as long as the liquid contains pigments. The second liquid may be, not limited to the above-described pretreatment liquid, an aftertreatmemt liquid that lands on a recording medium after the first liquid lands thereon, or may be any other liquid as long as the liquid contains no pigments.

A cap is not limited to be composed of the annular member 41 and the opposing member 42. For example, the cap may be composed of a single member having a concave shape which covers the ejection surface 10*x* from under the ejection surface 10*x*. This type of cap is, for example, made of a flexible material such as rubber as a whole and consists of a bottom portion and a lip portion which stands from an outer circumference of the bottom portion. When the cap is positioned at the capping position, an upper end of the lip portion is in contact with the ejection surface 10*x*, and a space between the ejection surface 10*x* and the bottom portion is defined by the lip portion as an ejection space. In a case of this type of cap, because the bottom portion and the lip portion are integral with each other, a plurality of lifting mechanisms are unnecessary. Further, since the bottom portion functions as the opposing member in the illustrated embodiments, there is no need to dispose an opposing member independently. Furthermore, especially in a case of this type of cap, a suction purging (a type of purging in which inside of the cap is sucked to negative pressure such that liquid is discharged from nozzles by suction power) may be adopted, instead of a pressurized purging (a type of purging in which liquid is supplied to a head by a pump such that liquid is discharged from nozzles) as in the illustrated embodiments. Furthermore, this type of cap may have a function to prevent viscosity of liquid in the nozzles, as well as a function to receive liquid discharged by a purging operation. If there is enough room for placement, a cap having a function to receive liquid discharged by a purging operation and a cap having a function to prevent viscosity of liquid in the nozzles may be disposed independently.

Though the wiping operation is performed after each purging in the illustrated embodiments, from viewpoint for reduction of time, a wiping operation may be performed only after the last first purging and second purging in the purging pattern (e.g., the last Pr purging and Bk purging in FIG. 8A). The two first purgings may not be performed successively in the certain purging period. Further, the two second purgings may be performed successively in the certain purging period.

A recording medium, not limited to the recording sheet P, may be any medium that is recordable. A liquid ejection apparatus is not limited to a printer, and may be a facsimile machine, a copier machine, or the like.

What is claimed is:

1. A liquid ejection apparatus comprising:

a first head having a plurality of nozzles from which a first liquid including pigments is ejected;

a second head having a plurality of nozzles from which a second liquid including no pigments is ejected;

a cap device configured to selectively change a state between a capping state in which the cap device covers the plurality of nozzles of the first head and the plurality of nozzles of the second head, and an uncapping state in which the cap device does not cover the plurality of nozzles of the first head and the plurality of nozzles of the second head;

a controller configured to:

control the first head and the second head to perform (i) a first purging operation in which the first head ejects the first liquid and the second head does not eject the second liquid, and (ii) a second purging operation in which the second head ejects the second liquid and the first head does not eject the first liquid; and such that the state of the cap device is one of the capping state and the uncapping state;

wherein the controller is configured to perform a certain combined-purging operation which at least two first purging operations and at least one second purging operation are performed in a period of the certain combined-purging operation, the number of times the at least two first purging operation are performed is greater than the number of times the at least one second purging operation is performed in the period of the certain combined-purging operation, and one of the at least two first purging operations is performed as the last purging operation in the period of the certain combined-purging; operation, and wherein the controller is configured to control the state of the cap device so as to be the uncapping state during the period of the certain combined-purging operation, operation and control the state of the cap device so as to be the capping state in periods before and after the period of the certain combined-purging operation.

2. The liquid ejection apparatus according to claim 1, wherein the controller is configured not to perform two consecutive second purging operations in the certain combined-purging operation.

3. The liquid ejection apparatus according to claim 1, wherein the controller is configured to perform the first purging operation consecutively following the second purging operation in the certain combined-purging operation.

4. The liquid ejection apparatus according to claim 1, wherein the controller is configured to perform a plurality of second purging operations in the certain combined-purging operation, and wherein the controller is configured not to perform two of the plurality of the second purging operations are not performed consecutively to each other in the certain combined-purging operation.

5. The liquid ejection apparatus according to claim 1, wherein the controller is configured to perform at least two first purging operations consecutively in the certain combined-purging operation.

6. The liquid ejection apparatus according to claim 1, wherein the controller is configured to perform a sequence in which the first purging operation is performed consecutively following the second purging operation, once or a plural number of times at the end of the period of combined-purging operation.

7. The liquid ejection apparatus according to claim 1, wherein the controller is configured to perform the first purging operation consecutively following the second purging operation as the last two purging operations in the period of the certain combined-purging operation.

8. The liquid ejection apparatus according to claim 1, wherein the first liquid is a pigment ink of black or color, and wherein the second liquid is a treatment liquid for coagulating pigments in the pigment ink.

* * * * *